US006269949B1

(12) United States Patent
Gottlieb

(10) Patent No.: US 6,269,949 B1
(45) Date of Patent: Aug. 7, 2001

(54) STACKABLE BEVERAGE CONTAINER WITH ROTATABLE HANDLE

(76) Inventor: Ron Gottlieb, 21 Willow Ridge Dr., Smithtown, NY (US) 11287

( * ) Notice: Subject to any disclaimer, the term of this patent is extended or adjusted under 35 U.S.C. 154(b) by 0 days.

(21) Appl. No.: 09/568,283

(22) Filed: May 10, 2000

(51) Int. Cl.[7] ..... B65D 2/02

(52) U.S. Cl. ..... 206/519; 220/739; 220/763; 220/760

(58) Field of Search ..... 206/519; 220/739, 220/763, 669, 760, 320, 765–769

(56) References Cited

U.S. PATENT DOCUMENTS

| | | | | |
|---|---|---|---|---|
| 2,252,360 | | 8/1941 | Barbieri . | |
| 3,594,891 | | 7/1971 | Cunningham . | |
| 3,623,633 | | 11/1971 | Kinn . | |
| 4,102,454 | * | 7/1978 | Karevaara | 220/519 |
| 4,572,374 | * | 2/1986 | Sirotkin | 206/519 |
| 5,080,281 | | 1/1992 | Seabold . | |
| 5,190,157 | * | 3/1993 | Przytulla | 206/519 |
| 5,222,656 | * | 6/1993 | Carlson | 220/739 |
| 5,393,292 | | 2/1995 | Sand . | |
| 5,469,983 | * | 11/1995 | Yawata | 220/739 |
| 5,680,944 | * | 10/1997 | Rueter | 220/739 |
| 6,036,047 | * | 3/2000 | Dobbie | 220/739 |

* cited by examiner

*Primary Examiner*—Joseph M. Moy
(74) *Attorney, Agent, or Firm*—Michael I. Kroll

(57) ABSTRACT

The present invention 10 discloses a plurality of beverage carrying cups which can be easily stacked. The beverage carrying containers have an insulated jacket 12 which substantially covers the exterior of the container providing insulated means for carrying hot liquids, as well as providing means for maintaining the temperature of the liquid. Further the beverage carrying containers have slidable rotatable retractable extendable handles 14. Each handle 14 is affixed to the container by rivet like members 16 located on the exterior upper portion of the container 10. The handle 14 in the retracted position conforms substantially to the exterior shape of the container. In the selectively extended position, the handle 14 slides down and is rotated into an upward operative position thereby enabling the user to carry the container 10 the handle 14.

6 Claims, 7 Drawing Sheets

STACKABLE BEVERAGE CONTAINER WITH ROTATABLE HANDLE

BACKGROUND OF THE INVENTION

1. Field of the Invention

The present invention relates generally to beverage containers and, more specifically, to a beverage container having an insulated jacket which substantially covers the exterior of the container providing insulated means for carrying hot liquids, as well as providing means for maintaining the temperature of the liquid.

Further said beverage carrying containers have slidable rotatable retractable extendable handles. Each handle is affixed to the container by rivet like members located on the exterior upper portion of the container. Said handle in the retracted position conform substantially to the exterior shape of the container. In the selectively extended position, the handle slides down and is rotated into an upward operative position thereby enabling the user to carry the container by the handle.

2. Description of the Prior Art

There are other containers devices having handles designed for carrying. Typical of these is U.S. Pat. No. 3,623,633 issued to Kinn on Nov. 30, 1971.

Another patent was issued to Cummingham on Jul. 27, 1971 as U.S. Pat. No. 3,594,891. Yet another U.S. Pat. No. 5,080,281 was issued to Seabold on Jan. 14, 1992 and still yet another was issued on Feb. 28, 1995 to Sand as U.S. Pat. No. 5,393,292.

Another patent was issued to Barbieri on Aug. 12, 1941 as U.S. Pat. No. 2,252,360.

U.S. Pat. No. 3,623,633

Inventor: Arthur W. Kinn

Issued: Nov. 30, 1971

A handle for a container consisting of an elongated flexible strip having opposite ends secured at spaced locations to the peripheral surface of the container in a manner that the length of the unsecured portion of the strip is greater than the peripheral dimension between the spaced locations. A double fold is produced in the elongated strip, between the spaced locations, to define a first position locating the unsecured portion of the strip substantially flush with the peripheral surface of the container. The adhesive securement terminates along lines which are angularly related to the elongated axis of the strip so that the unsecured upper edge of the strip is shorter that the unsecured lower edge. The strip is movable to an operative position by unfolding and reversing the strip along the adhesive termination lines to produce a handle which extends above the container.

U.S. Pat. No. 3,594,891

Inventor: Ernest R. Cummings

Issued: Jul. 27, 1971

This invention relates to a plastic container carrier and the provision of a generally U-shaped bail portion for the container carrier. The carrier is formed from a strip of thermoplastic material and the bail portion is formed coplanar with the remaining portion of the carrier. The bail portion is cold worked to increase its length, decrease its thickness and provide a flexible handle for the container carrier.

U.S. Pat. No. 5,080,281

Inventor: Thomas W. Seabold

Issued: Jan. 14, 1992

A handle for use with an object. The handle is attached to the object in a generally flush manner, but may be expanded to a position for manual engagement to manipulate the object.

U.S. Pat. No. 5,393,292

Inventor: Dale L. Sand

Issued: Feb. 28, 1995

A machine for securing a thermoplastic coated paper handle to a paper cup having a seam on one side of the cup, the machine including a die assembly for forming paper handles having a backing strip and a wing on each side of the strip, a mandrel turrent having a number of mandrels spaced about the perimeter of the turrent, each of said mandrels having a blade assembly project outwardly from the surface of the mandrel to encase the seam in the cup and a wheel assembly for rotating the cups on the mandrel to move the seam in the cup into engagement with the blade assembly, and a transfer turrent for transferring the paper handles from the die assembly to the mandrel turrent for attachment to the cups.

U.S. Pat. No. 2,252,369

Inventor: Cesare Barbieri

Issued: Aug. 12, 1941

This United States Patent discloses an improvement to containers and a method of making the same, the container being of the general character of flat bottom paper drinking cups and may be manufactured on known paper drinking cup machines. The container has a double or multi-thickness wall to materially strengthen the container and enable it to carry hot or cold substances for a considerable time without material weakening of the container and without an objectionable change in temperature of the substance.

While these containers devices having handles designed for carrying may be suitable for the purposes for which they were designed, they would not be as suitable for the purposes of the present invention, as hereinafter described.

SUMMARY OF THE PRESENT INVENTION

The present invention discloses a plurality of beverage carrying cups which can be easily stacked. The beverage carrying containers have an insulated jacket which substantially covers the exterior of the container providing insulated means for carrying hot liquids, as well as providing means for maintaining the temperature of the liquid. Further the beverage carrying containers have slidable rotatable retractable extendable handles. Each handle is affixed to the container by rivet like members located on the exterior upper portion of the container. The handle in the retracted position conforms substantially to the exterior shape of the container. In the selectively extended position, the handle slides down and is rotated into an upward operative position thereby enabling the user to carry the container by the handle.

A primary object of the present invention is to provide a disposable container having a handle.

Another object of the present invention is to provide a stackable beverage container having a handle.

Yet another object of the present invention is to provide a beverage container having a handle which conforms to the exterior shape of the beverage container while in the folded position.

Still yet another object of the present invention is to provide a beverage container having a handle and an insulated jacket.

Yet another object of the present invention is to provide a beverage container having a slot in the handle whereby said handle can be retracted to a non-operative position or extended for rotation to an operative position.

Additional objects of the present invention will appear as the description proceeds.

The present invention overcomes the shortcomings of the prior art by providing. The present invention relates generally to beverage containers and, more specifically, to a beverage container having an insulated jacket which substantially covers the exterior of the container providing insulated means for carrying hot liquids, as well as providing means for maintaining the temperature of the liquid.

Further said beverage carrying container has a slidable rotatable retractable extendable handle. Said handle is affixed to the container by rivet like members located on the exterior upper portion of the container. Said handle in the retracted position conform substantially to the exterior shape of the container. In the selectively extendable position, the handle slides down and is rotated into an upward operative position thereby enabling the user to carry the container by the handle.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
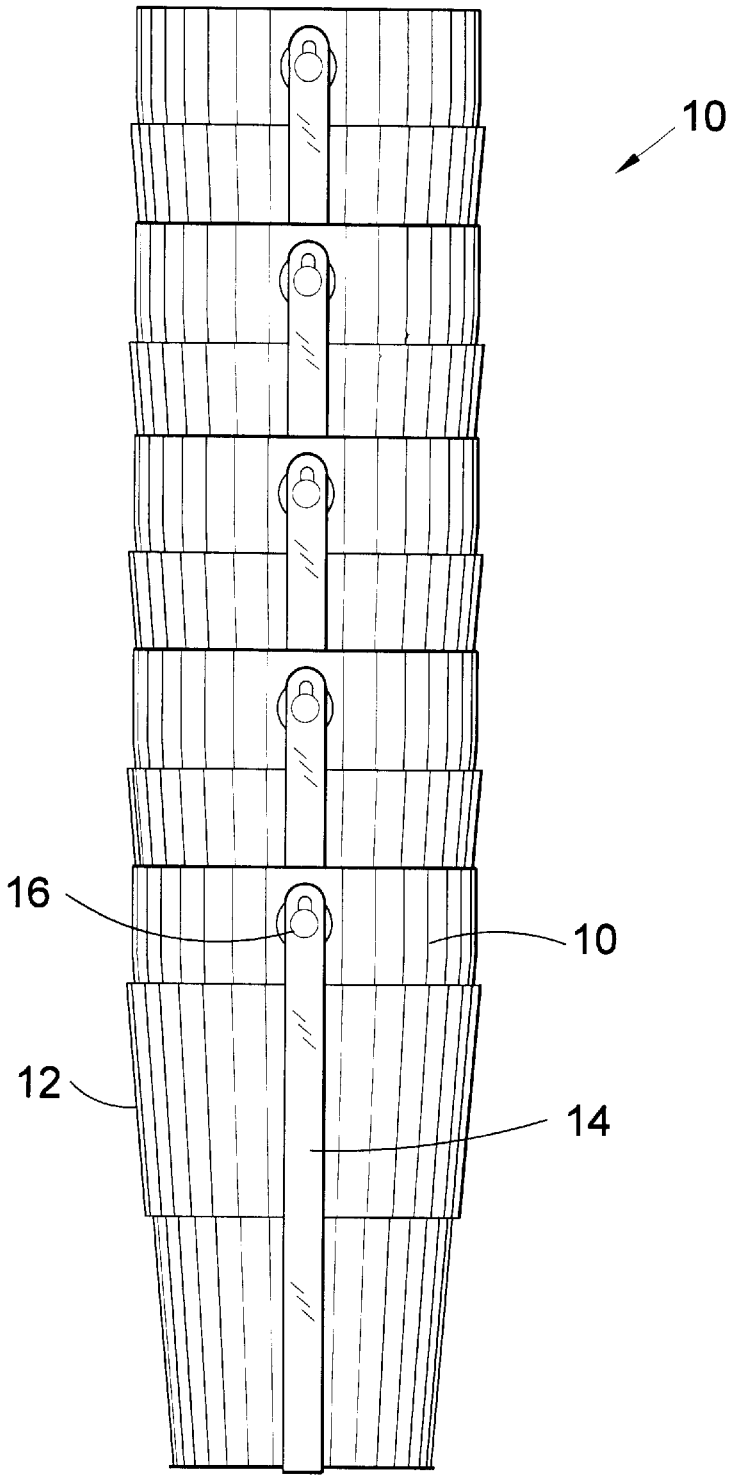
FIG. 1 is a front elevation of a plurality of beverage carrying cups in a stacked position. The beverage carrying containers have an insulated jacket which substantially covers the exterior of the container providing insulated means for carrying hot liquids, as well as providing means for maintaining the temperature of the liquid. Further said beverage carrying containers have slidable rotatable retractable extendable handles. Each handle is affixed to the container by rivet like members located on the exterior upper portion of the container. Said handle in the retracted position conform substantially to the exterior shape of the container. In the selectively extended position, the handle slides down and is rotated into an upward operative position thereby enabling the user to carry the container by the handle.

With regard to reference numerals used, the following numbering is used throughout the drawings:

10 present invention
12 insulated jacket
14 handle
16 rivet
18 arrow

20 aperture

22 bottom, outer edge of cup

24 head of rivet

26 base of rivet

DESCRIPTION OF THE PREFERRED EMBODIMENT(S)

In order that the invention may be more fully understood, it will now be described, by way of example, with reference to the accompanying drawings in which FIGS. 1 through 7 illustrate the present invention being a stackable beverage container having a rotating handle.

Turning to FIG. 1, shown therein is a front elevation of the present invention 10 being a plurality of beverage carrying cups in a stacked position. The beverage carrying containers have an insulated jacket 12 which substantially but only partially covers the exterior of the container providing insulated means for carrying hot liquids, as well as providing means for maintaining the temperature of the liquid. Further the beverage carrying containers have slidable rotatable retractable extendable handles 14. Each handle 14 is affixed to the container by rivet like members 16 located on the exterior upper portion of the container 10. The handle 14 in the retracted position conforms substantially to the exterior shape of the container. In the selectively extended position, the handle 14 slides down and is rotated into an upward operative position thereby enabling the user to carry the container 10 by the handle 14.

Figure 2:
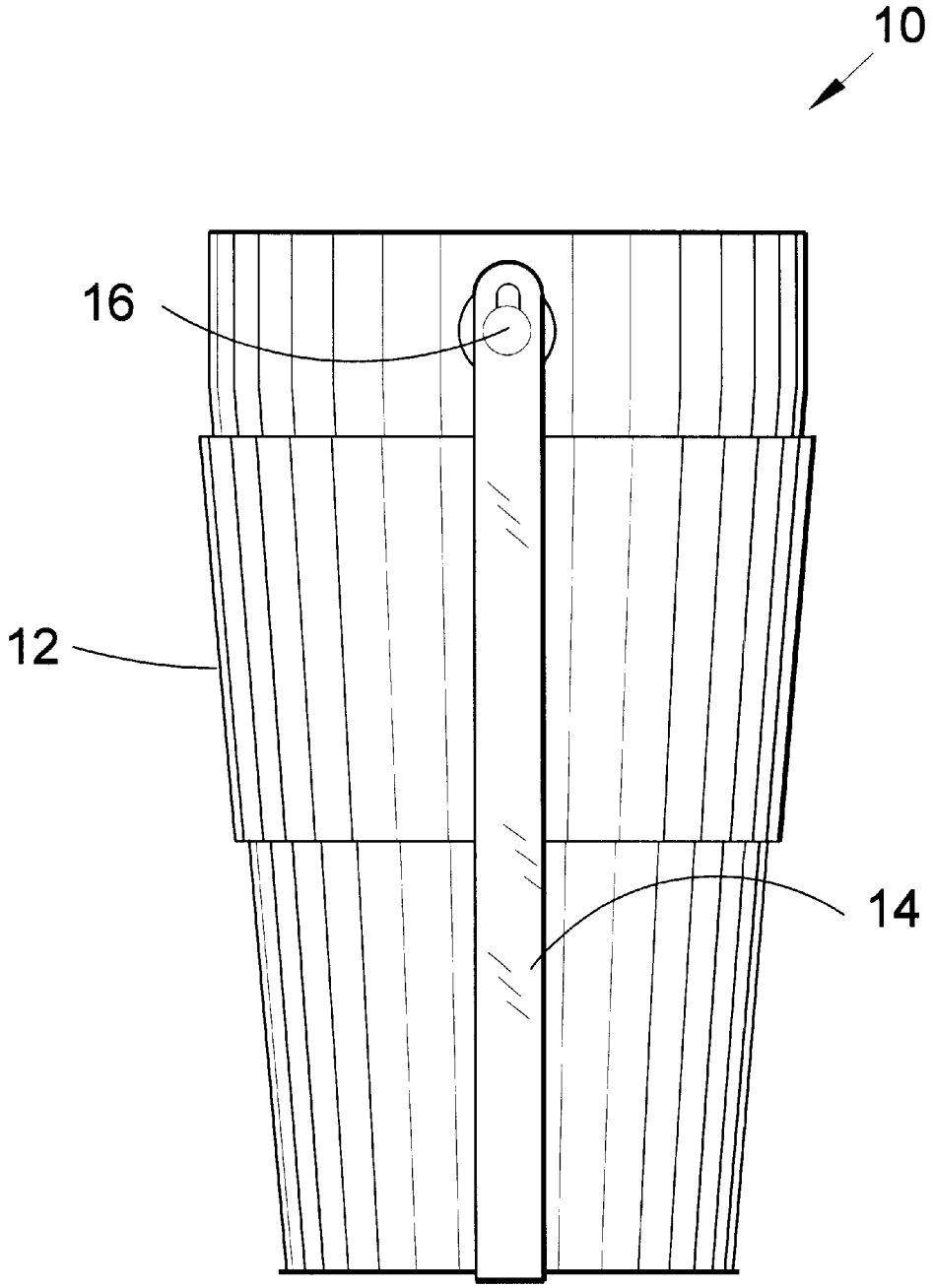
FIG. 2 is a front elevation of the preferred embodiment of the present invention. Shown is a beverage carry container having an insulated jacket substantially covering the exterior of the container providing means for carrying hot liquids, as well as providing means for maintaining the temperature of the liquid. Further said beverage carrying container has a slidable rotatable retractable extendable handle. Said handle is affixed to the container by rivet like members located on the exterior upper portion of the container. Said handle in the retracted position conform substantially to the exterior shape of the container. In the selectively extended position, the handle slides down and is rotated into an upward position thereby enabling the user to carry the container by the handle.

Turning to FIG. 2, shown therein is a front elevation of the preferred embodiment of the present invention 10. Shown is a beverage carry container 10 having an insulated jacket 12 substantially covering the exterior of the container providing means for carrying hot liquids, as well as providing means for maintaining the temperature of the liquid. Insulation 12 covers about 75% of the exterior of cup 10, covering only the lower portion of cup 10. Further the beverage carrying container 10 has a slidable rotatable retractable extendable handle 14. The handle 14 is affixed to the container by rivet like members 16 located on the exterior upper portion of the container. The handle 14 in the retracted position conform substantially to the exterior shape of the container. In the selectively extended position, the handle 14 slides down and is rotated into an upward position thereby enabling the user to carry the container 10 by the handle 14.

Figure 3:
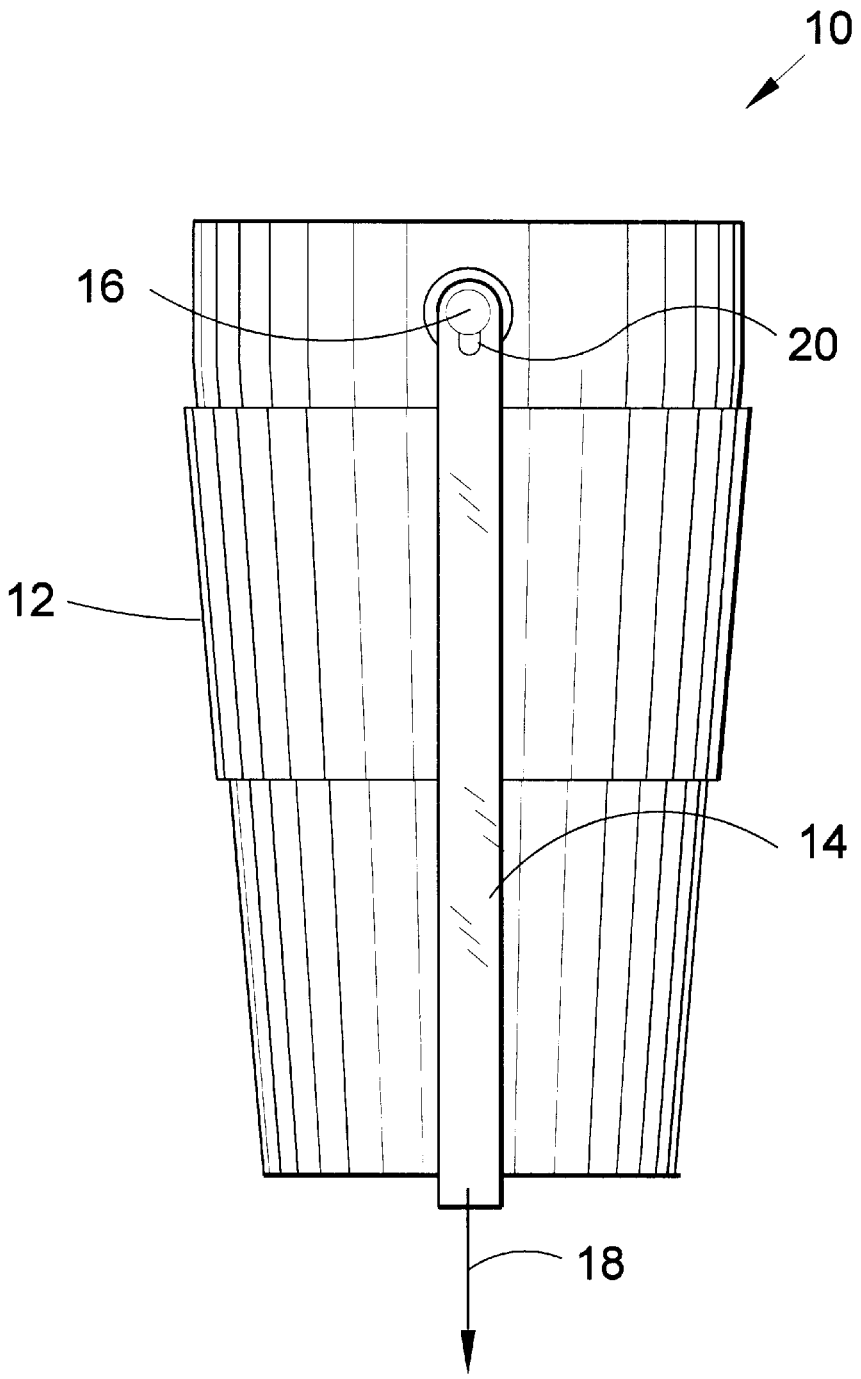
FIG. 3 is a front elevation of the preferred embodiment of the present invention. Shown is a beverage carry container having an insulated jacket substantially covering the exterior of the container providing means for carrying hot liquids, as well as providing means for maintaining the temperature of the liquid. Also shown is the handle being moved to an operative position by first sliding said handle down until the slot centered around the rivet-like handle retaining member has stopped further extension efforts.

Turning to FIG. 3, shown therein is a front elevation of the preferred embodiment of the present invention 10. Shown is a beverage carry container 10 having an insulated jacket 12 substantially covering the exterior of the container providing means for carrying hot liquids, as well as providing means for maintaining the temperature of the liquid. Also shown by direction arrow 18 is the handle 14 being moved to an operative position by first sliding the handle down until the elongated aperture 20 centered around the rivet-like handle retaining member has stopped further extension efforts.

Figure 4:
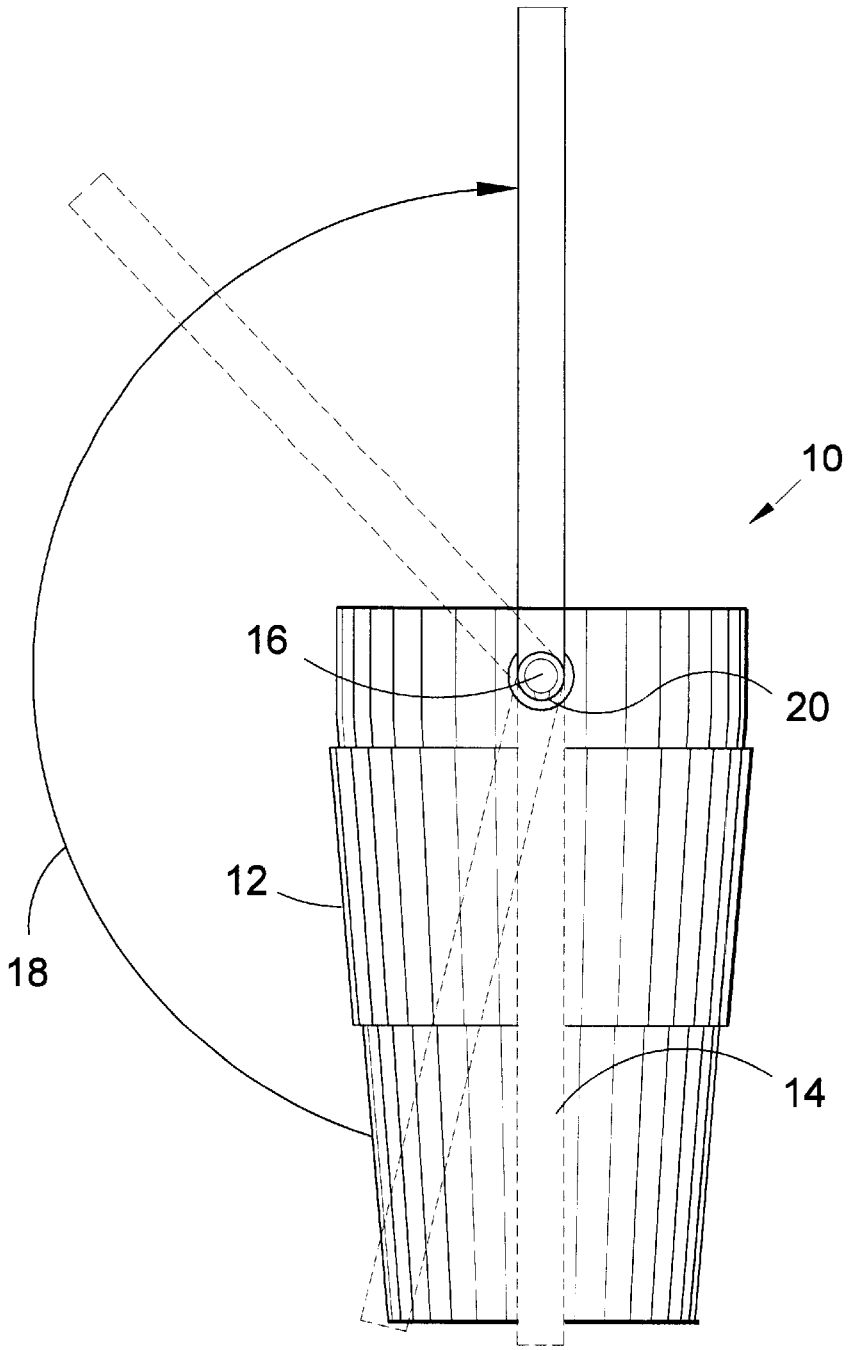
FIG. 4 is a front elevation of the preferred embodiment of the present invention. Shown is a beverage carry container having an insulated jacket substantially covering the exterior of the container providing means for carrying hot liquids, as well as providing means for maintaining the temperature of the liquid. Also shown is the handle after being moved to an operative position by first sliding said handle down until the slot centered around the rivet-like handle retaining member has stopped further extension efforts wherein said handle is rotated to an upward position whereby said container can be carried by said handle.

Turning to FIG. 4, shown therein is a front elevation of the preferred embodiment of the present invention 10. Shown is a beverage carry container having an insulated jacket 12 substantially covering the exterior of the container providing means for carrying hot liquids, as well as providing means for maintaining the temperature of the liquid. Also shown by arrow 18 is the handle 14 after being moved to an operative position by first sliding the handle down until the elongated aperture 20 centered around the rivet-like handle retaining member 16 has stopped further extension efforts wherein the handle is rotated to an upward position whereby the container 10 can be carried by the handle 14. Aperture 20 must be long enough to allow handle 14 to rotate past the bottom, outer edge 22 of cup 10. Note that cup 10 has a smaller diameter at its bottom than at its upper end whereby multiple cups 10 are stackable on each other.

Figure 5:
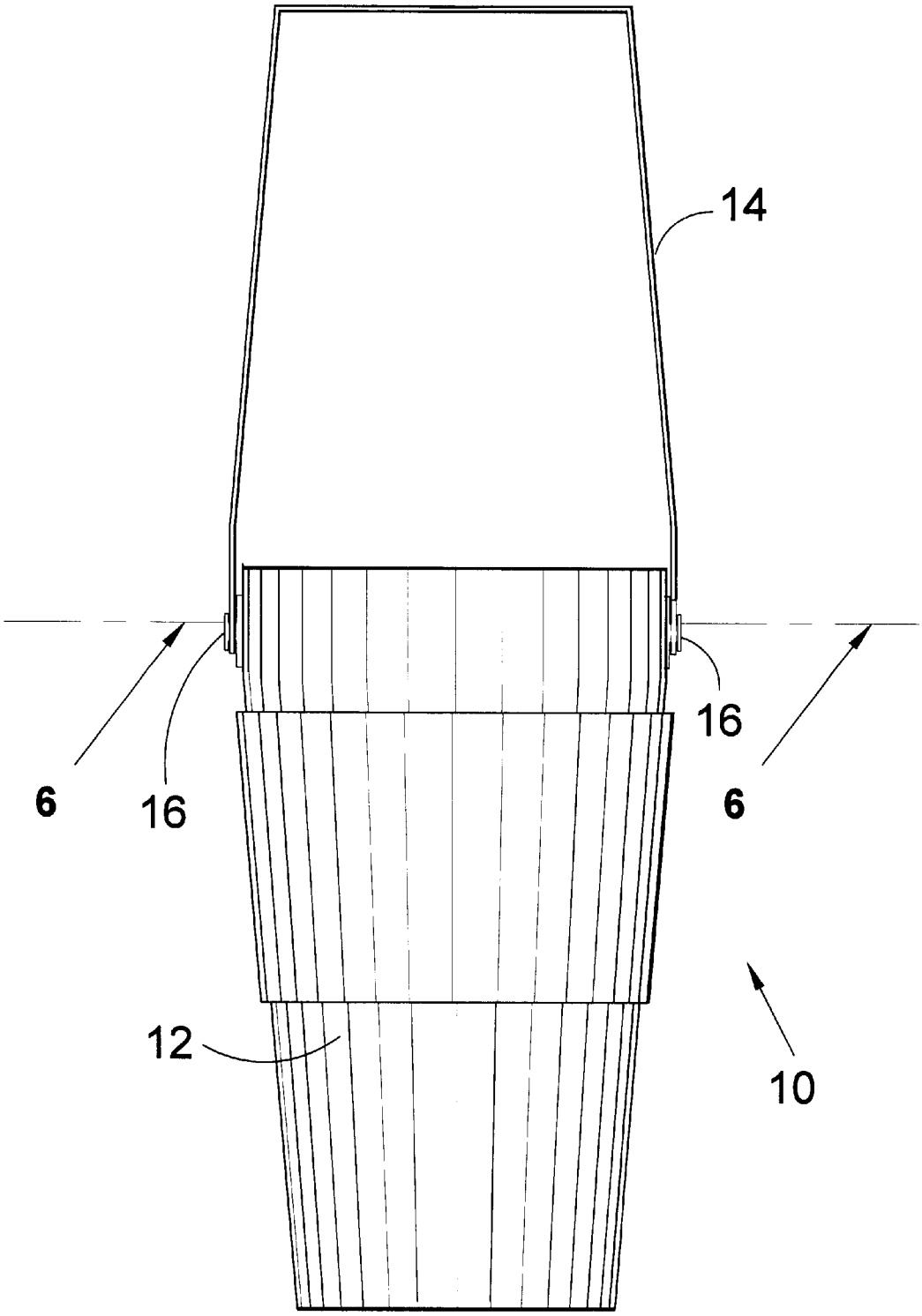
FIG. 5 is a front elevation of the preferred embodiment of the present invention. Shown is a beverage carry container having an insulated jacket substantially covering the exterior of the container providing means for carrying hot liquids, as well as providing means for maintaining the temperature of the liquid. Also shown is the handle having been rotated to an upward operative position whereby said beverage container can be carried by said handle.

Turning to FIG. 5, shown therein is a front elevation of the preferred embodiment of the present invention 10. Shown is a beverage carry container 10 having an insulated jacket 12 substantially covering the exterior of the container providing means for carrying hot liquids, as well as providing means for maintaining the temperature of the liquid. Also shown is the handle 14 having been rotated to an upward operative position whereby the beverage container 10 can be carried by the handle 14. Handle 14 is attached on a first and second side of container 10 by a pair of means 16, e.g., rivets.

Figure 6:
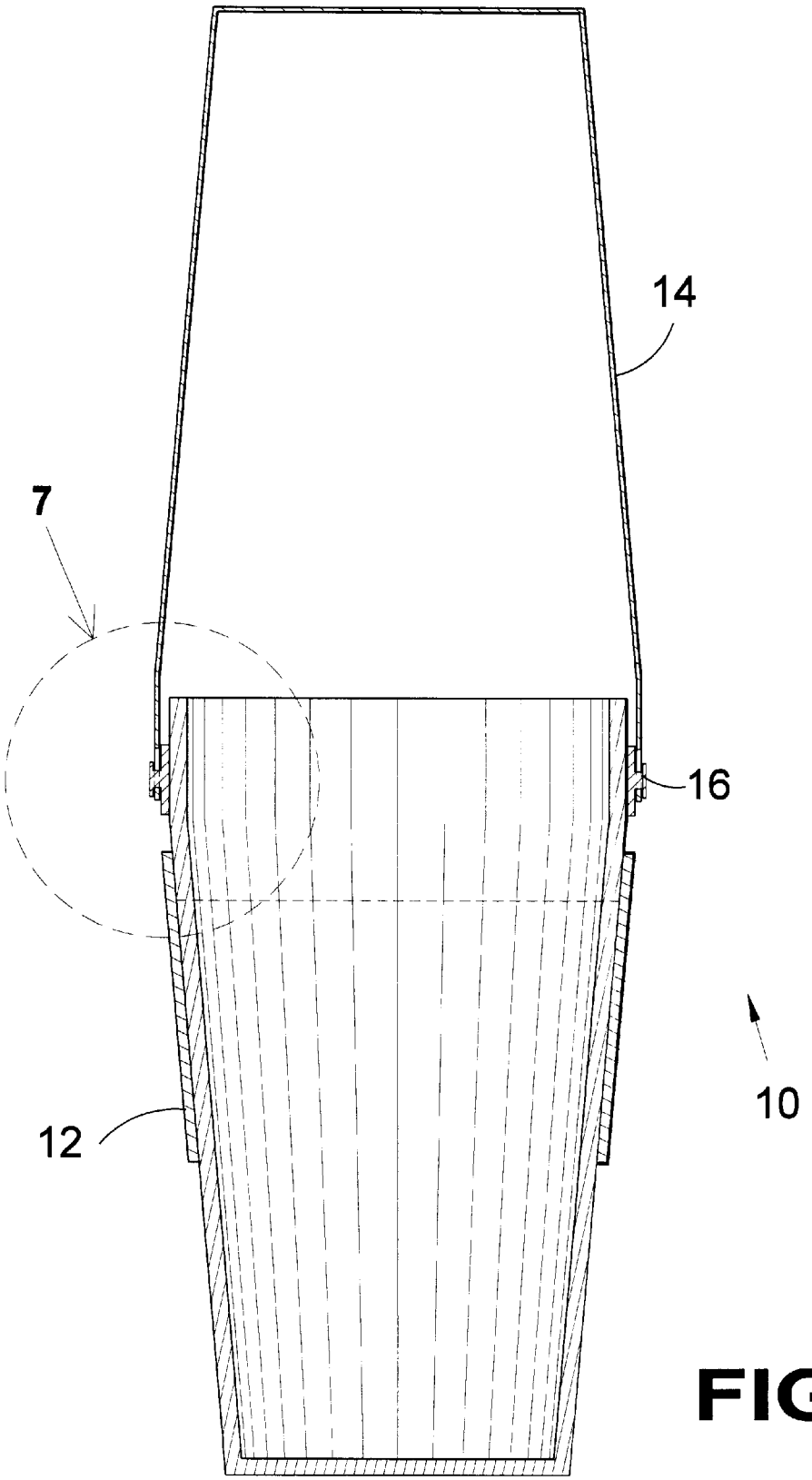
FIG. 6 is a cross sectional view, taken from FIG. 5 as indicated. Shown is a beverage container having an exterior insulated jacket substantially covering the container. Also shown are rivet-like members affixed to the upper exterior portion of the cup whereupon is fixed the handle having a slot whereby said handle can be selectively moved to either an operative or non-operative position.

Turning to FIG. 6, shown therein is a cross sectional view, taken from FIG. 5 as indicated. Shown is a beverage container 10 having an exterior insulated jacket 12 substantially covering the container. Also shown are rivet-like members 16 affixed to the upper exterior portion of the cup 10 whereupon is fixed the handle 14 having a slot or aperture whereby the handle can be selectively moved to either an operative or non-operative position.

Figure 7:
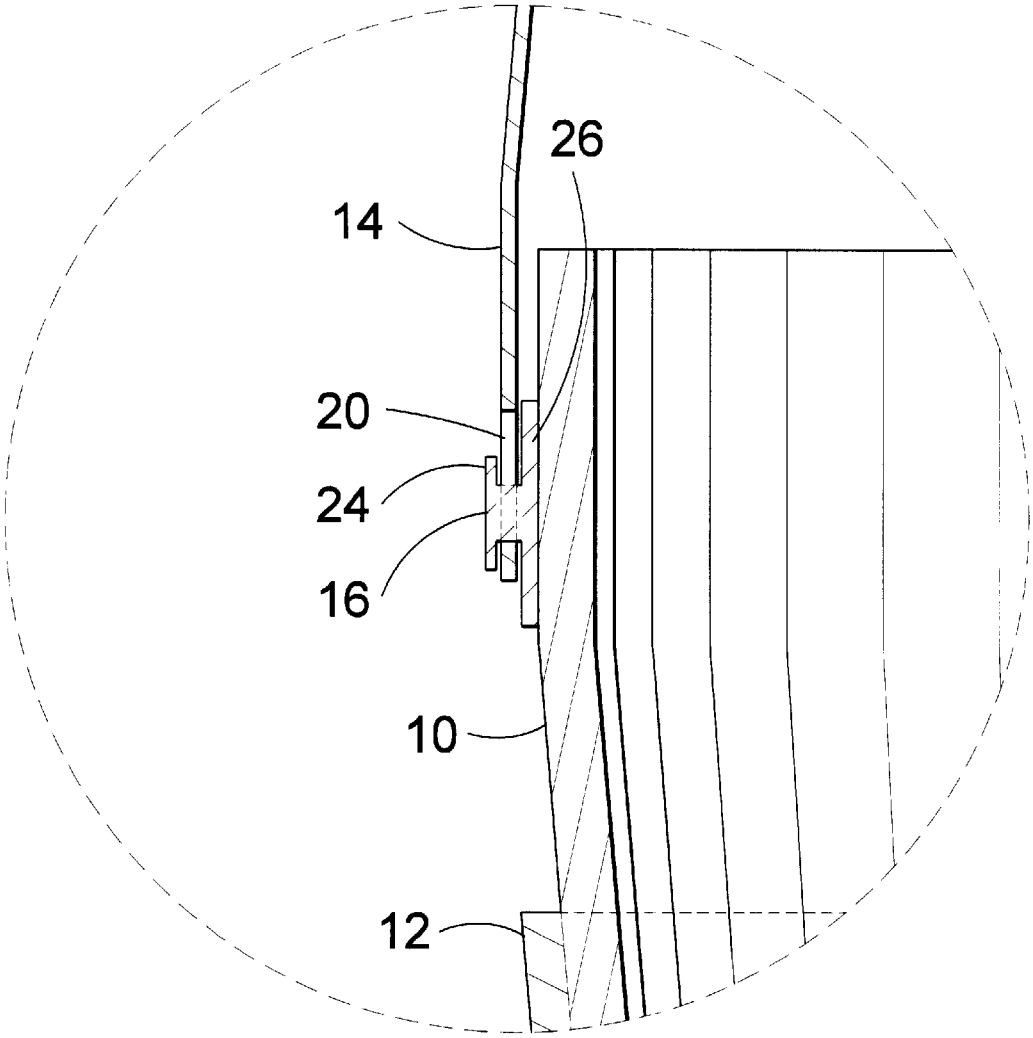
FIG. 7 is an enlarged view, taken from FIG. 6 as indicated. Shown is the rivet-like handle retaining member whereupon a slot in the rotatable handle provides means for moving the handle from or into an operative position.

Turning to FIG. 7, shown therein is an enlarged view, taken from FIG. 6 as indicated. Shown is the rive-like handle retaining member 16 whereupon a slot or aperture 20 in the rotatable handle 14 provides means for moving the handle from or into an operative position. The cup wall 10 and insulated jacket 12 wherein the jacket 12 is about the thickness of the cup wall 10 is also shown. Aperture 20 has a width less than the diameter of the head 24 of rivet 16 whereby handle 14 rotates about rivet 16 but also is secured to rivet 16. The base 26 of the rivet 16 is also shown attached to the exterior of the upper portion of the cup 10. Rivet head 24 has a smaller diameter than rivet base 26. What is claimed to be new and desired to be protected by Letters Patent is set forth in the appended claims:

I claim:

1. An apparatus for holding liquids, comprising:

a) a cup having an open, upper end and a closed bottom end, the bottom end of said cup having a diameter which is less than the diameter of the upper end thereby permitting the stacking of a plurality of the cups;

b) an insulated jacket attached to the outside of said cup;

c) a handle for carrying said cup; and, d) means for attaching said handle to said cup so that said handle is rotatable between a lifting position in which said handle extends upwardly from the upper end of said cup and a retracted position in which said handle extends downwardly from the upper end of said cup and around the bottom end of said cup, said handle in the retracted position conforming substantially to the exterior shape of the cup thereby allowing stacking of said cup in another said cup with the handle nesting in the cup beneath.

2. The apparatus of claim 1 in which said handle has first and second ends and said attaching means connects said ends to opposite sides of said cup adjacent the upper end of said cup, said attaching means allowing limited vertical movement of said handle whereby in the retracted position said handle may be snug against the bottom end of said cup to permit said stacking and movable a sufficient distance downwardly to allow said handle to be rotated around the bottom into the holding position.

3. The apparatus of claim 2, said means for attaching said handle to said cup further comprises said handle having an aperture in each of its ends.

4. The apparatus of claim 3, further comprising a pair of rivet means disposed near said upper end of said cup, said rivet means for receiving the apertures of said handle.

5. The apparatus of claim 4, wherein each said aperture of said handle is elongated.

6. The apparatus of claim 5, wherein each said elongated aperture is effectively long enough to allow said handle to rotate past said bottom end of said cup, said handle for carrying said cup.

* * * * *